United States Patent [19]

Jones

[11] Patent Number: 4,555,212

[45] Date of Patent: Nov. 26, 1985

[54] APPARATUS FOR RUPTURING CARRIER BAGS

[76] Inventor: Robert C. Jones, P.O. Box 27, Napoleon, Ohio 43545

[21] Appl. No.: 685,596

[22] Filed: Dec. 24, 1984

Related U.S. Application Data

[63] Continuation of Ser. No. 402,304, Jul. 27, 1982, abandoned.

[51] Int. Cl.[4] ..... B65B 69/00

[52] U.S. Cl. ..... 414/412; 241/260.1; 241/285 B

[58] Field of Search ..... 414/412; 241/260.1, 241/285 A, 285 B

[56] References Cited

U.S. PATENT DOCUMENTS

| | | | |
|---|---|---|---|
| 2,717,742 | 9/1955 | Weigham et al. | 241/260.1 |
| 4,043,514 | 8/1977 | Peterson | 241/285 B |
| 4,182,592 | 1/1980 | Henryson | 414/412 |
| 4,278,384 | 7/1981 | Marchesini | 414/412 |

*Primary Examiner*—Robert G. Sheridan
*Attorney, Agent, or Firm*—Fraser & Clemens

[57] ABSTRACT

A method and apparatus for rupturing refuse carrier bags to expose the potentially salvagable materials therein is disclosed. A transport tube is provided with an inlet end having an upper circumferential portion cut away to receive carrier bags placed therein and an outlet end having an opening for expelling the contents of the carrier bags. A screw impeller means is rotatably supported in the transport tube. Drive means are provided for rotating the screw impeller within the transport tube to advance the carrier bags from the inlet end toward the outlet end. A sleeve means is formed is about the screw impeller between the inlet end and outlet end of the transport tube. The sleeve is slightly larger in diameter than the screw impeller. The upper portions of the carrier bags engage the sleeve and are thereby prevented from being further advanced through the transport tube. The screw impeller then ruptures the carrier bag to expose the contents therein.

1 Claim, 2 Drawing Figures

APPARATUS FOR RUPTURING CARRIER BAGS

This is a continuation of application Ser. No. 402,304, filed July 27, 1982, now abandoned.

BACKGROUND OF THE INVENTION

1. Field Of The Invention

Reclamation of solid refuse is playing an increasingly important role in modern waste disposal systems. Beyond the obvious ecological advantages of salvaging recyclable materials, the monetary value of certain commonly discarded materials makes solid waste reclamation economically feasible. However, such a reclamation system requires hand or other sorting of the desired valuable materials, such as aluminum, ferrous metals, and the like, from the undesired materials.

The sorting operation is often located at the site of a landfill. Typically, solid waste is dumped onto a conveyor which transports the refuse through a sorting area. The desired materials are removed from the conveyor and placed in appropriate storage areas while the undesired materials remain on the conveyor and are delivered to the landfill pit. A major problem encountered in these sorting operations is that much of the refuse to be sorted is packaged in standard plastic or paper refuse carrier bags. The openings of such carrier bags are tightly closed, usually by a wire or plastic tie member or simply by knotting the open end. In any event, the carrier bags are designed to resist any attempt to tear or otherwise open them to expose the contents therein. Such carrier bags, therefore, interpose a considerable time and energy-consuming delay in a reclamation operation which relies upon the rapid and efficient sorting of materials for economic feasibility. Accordingly, it would be desirable to provide a simple and efficient means for opening carrier bags containing refuse to expose the contents therein.

2. Description of The Prior Art

The common method of opening carrier bags is simply to cut the bags open with a knife blade of some sort. In some instances, a person is provided on the conveyor line to cut open the bags and expose the refuse therein before it reached the sorting area. However, the requirement of an additional person in the reclamation system decreases the efficiency of the operation. In other instances, a machine is provided with cutting blades to chop open the carrier bags. Such cutting machines suffer from frequent breakdowns caused by the striking of the cutting blade against unyielding solid objects within the carrier bag. Trommels and shredders have also been utilized in the past to tear open carrier bags. However, such devices destroy the original shape of the articles of refuse contained in the carrier bags, making sorting of the articles quite difficult.

U.S. Pat. No. 3,074,534 to Thiele discloses a material handling apparatus for distributing livestock feed to a plurality of spaced feeding bins. The apparatus includes a feed receiving hopper, a cylindrical auger tube extending outwardly from the hopper above the bins and having discharge openings in the lower side thereof above each bin, and a conveying auger extending from the hoppers through the tube. Rotary driving means rotate the auger to displace material from the hopper through the auger tube to each of the discharge openings.

U.S. Pat. No. 3,176,832 to Wilkes discloses a bulk feeder having an elongated auger tube assembly with a continuous slot extending from one end to the other end with a lower lip over which material may be discharged. An auger flighting is provided within the tube assembly. Track structures extend around the tube assembly and outwardly thereof. Each of the track structures has a continuous outer track spaced from the tube assembly and radial flange extending inwardly from the track and fixed to the surface of the tube assembly. The radial flange has a radially outward recess formed across the expanse of the slot.

U.S. Pat. No. 3,232,419 to Rasmussen discloses a screw conveyor including a casing having an inlet open to a region at one pressure and an outlet open to a region at a different pressure. A shaft extends through the casing from the inlet to the outlet. A first screw impeller on the shaft advances material through the casing from the inlet towards the outlet. Means are provided for defining a chamber above and open to the casing between the inlet and the outlet. A second screw impeller on the shaft of a hand opposite to that of the first impeller is provided to backup the material to form a pile of material in the chamber thereby sealing the casing at the upstream side of the chamber. The second screw impeller has an inclined surface down which the material slides into the casing near the downstream side of the chamber.

U.S. Pat. No. 3,312,329 to Hokana discloses a feed processing assembly including a gravity feed tank having a least one separator arranged longitudinally of the gravity feed tank to divide it into a plurality of elongated compartments. Each of the compartments has an inclined bottom terminating in a gate means. The gate means leads to a receiving area for dispensing the feed. An enclosed screw conveyor is positioned substantially longitudinally and centrally of the gravity feed tank. One end of the conveyor extends beyond the gravity feed tank to the receiving area. The conveyor is open at one end to collect and remove material from the area to a processing mill.

U.S. Pat. No. 4,310,089 to Bondeson et al. discloses a conveyor for transporting bags of refuse including a feed tube in which bags of refuse are introduced and transported from one end to the other and a feed screw in the tube for driving the bags of refuse through the tube. The feed screw is constructed as a helix forming successive spaced flanges. The pitch of the helix is such that the space between successive flanges will accommodate a bag of refuse of predetermined maximum overall size. The feed screw is eccentrically journalled in the feed tube and is in tangential contact at the bottom thereof.

SUMMARY OF THE INVENTION

The present invention relates to a method and apparatus for rupturing refuse carrier bags to expose the potentially salvagable materials therein. A transport tube is provided with an inlet end having an upper circumferential portion cut away to receive carrier bags placed therein and an outlet end having an opening for expelling the contents of the carrier bags. A screw impeller means is rotatably supported in the transport tube. Drive means are provided for rotating the screw impeller within the transport tube to advance the carrier bags from the inlet end toward the outlet end. A sleeve means is formed about the screw impeller between the inlet end and outlet end of the transport tube. The sleeve is slightly larger in diameter than the screw impeller. The upper portions of the carrier bags engage the sleeve and are thereby prevented from being further advanced through the transport tube. The screw impeller then ruptures the carrier bag to expose the contents therein without destroying the original shape of those contents.

It is an object of the present invention to provide an improved machine for rupturing carrier bags containing salvagable solid refuse.

It is another object of the present invention to increase the efficiency of a solid waste reclamation system.

It is a further object of the present invention to provide an apparatus for rupturing carrier bags which is simple and inexpensive in construction.

Other objects and advantages of the present invention will become apparent to those skilled in the art from the following detailed description of the preferred embodiment, when read in light of the accompanying drawings.

DETAILED DESCRIPTION OF THE PREFERRED EMBODIMENT

Figure 1:
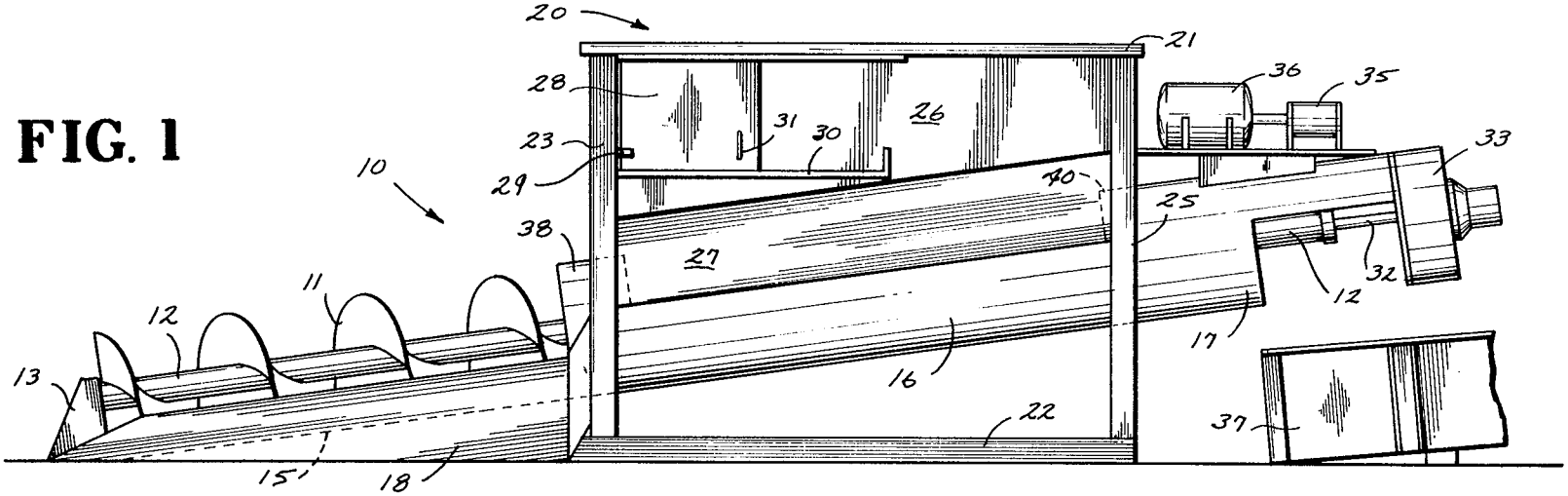
FIG. 1 is a side elevational view of an apparatus for rupturing refuse carrier bags in accordance with the present invention.
Figure 2:
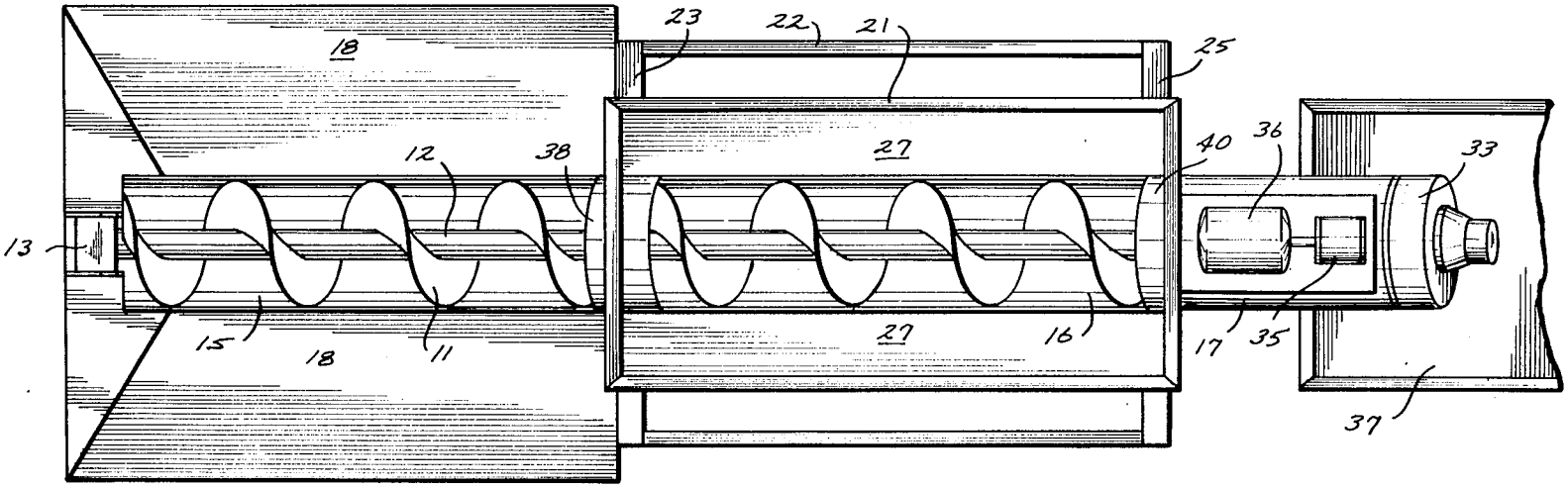
FIG. 2 is a top plan view of the apparatus of FIG. 1.

Referring now to the drawings, there is illustrated in FIGS. 1 and 2 an apparatus for rupturing refuse carrier bags, indicated generally at 10, in accordance with the present invention. One end of a shaft 12 of a screw impeller 11 is supported in a bearing assembly 13 which typically includes a journal bearing or other conventional means for rotatably supporting the shaft 12. The screw impeller 11 extends longitudinally throughout the apparatus 10 and is inclined at a slight upward angle therein.

A cylindrical transport tube or trough having an inlet end portion 15, a central portion 16, and an outlet end portion 17, is disposed about the screw impeller 11 and is generally coaxial therewith. The upper circumferential surface of the inlet end portion 15 is open to thereby expose the impeller 11 and shaft 12. The bottom half of the inlet end portion 15 is enclosed by an inclined surface ramp structure including a pair of oppositely extending and downwardly inclined planar sheet metal members 18. The members 18 extend upwardly from the ground to the edge of the inlet end portion 15 of the transport tube. The inclined surfaces of the members 18 provide a smooth surface upon which refuse can be pushed into the inlet end portion 15 of the transport tube about the screw impeller 11.

The central portion 16 of the transport tube extends through and forms the bottom surface of an enclosed hopper, indicated generally at 20. The hopper 20 includes an upper rim 21, a base 22, front and rear walls 23 and 25, respectively, which are connected at their upper edges to the rim 21, and a pair of opposing side walls extending between the front and rear walls 23 and 25. Each side wall includes a vertically-extending portion 26 depending downwardly from the rim 21 and an inwardly-slanting portion 27 connecting the bottom edge of the vertical portion 26 to the side of the central portion 16 of the tube. As with the inlet end 15 of the tube, the upper circumferential surface of the central portion 16 of the tube is cut away to expose the screw impeller 11 and shaft 12 therein.

If desired, a door 28 having a microswitch 29 mounted thereon can be provided in the vertical portion 26 of one side wall of the hopper 20 to permit easy access to the interior thereof. The door 28 can be slidably mounted on a track 30 and provided with a slotted grip portion 31 such that an operator can easily grasp the grip portion 31 and slide the door 28 sideways to provide access to the interior of the hopper 20. It may be necessary on some occasions to reach inside the hopper 20 to free articles of refuse in the event of jamming or repair of the screw impeller 11 and transport tube. As will be described below, the microswitch 29 provides a means for stopping the rotation of the screw impeller 11 when the door 28 is not properly closed.

The outlet end portion 17 of the transport tube extends outwardly from the hopper 20. The lower circumferential surface of the outlet end portion 17 is cut away, exposing the impeller 11 and shaft 12. The impeller shaft 12 is connected to a shaft portion 32 of a hydraulic motor 33. In the illustrated embodiment, the hydraulic motor 33 is secured to the outlet end portion 17 of the transport tube so as to impart rotary driving movement of the screw impeller 11 and shaft 12 therein. The hydraulic motor 33 is driven by a hydraulic pump 35 which is, in turn, driven by an electric motor 36. A conveyor means 37 is disposed beneath the cut away portion of the outlet end portion 17 such that the materials being expelled therefrom will fall onto the conveyor. The microswitch 29 is connected in an electrical circuit with the electric motor 36 such that the electric motor 36 is disabled when the door 28 is not properly closed to prevent accidental entry into the hopper 20.

A first sleeve means 38 is formed about the screw impeller 11 between the inlet and end portion 15 and the central portion 16 of the transport tube. A second sleeve means 40 is formed about the screw impeller 11 between the central portion 16 and the outlet end portion 17 of the transport tube. As shown in the drawings, the first and second sleeves 38 and 40, respectively, may be formed integrally with the transport tube, being defined by the cut away portions thereof. The first and second sleeves 38 and 40 are slightly larger in diameter than the diameter of the screw impeller 11. In practice, it has been found desirable to utilize a screw impeller 11 having a diameter of twenty-three inches and a transport tube having a diameter of twenty-four inches.

In operation, garbage from a truck, including carrier bags containing potentially salvagable refuse, is dumped onto the screw impeller 11 at the inlet end 15 of the transport tube. As the screw impeller 11 is rotated, normally at a speed of about thirty-five revolutions per minute, the refuse is advanced upwardly through the transport tube toward the first sleeve 38. Typically, refuse carrier bags are larger in size than the space provided between the screw impeller 11 and the first sleeve 38. The carrier bags thus engage the first sleeve 38 and are prevented from being further advanced through the transport tube into the hopper 20. The rotation of the screw impeller 11 ruptures the carrier bags, exposing the contents therein and allowing those contents to be advanced into the central portion 16 of the transport tube.

The hopper 20 provides an automatic feeder for the transport tube. Refuse which is dumped into the hopper 20 slides down the slanted side walls 27 into the central portion 16 of the transport tube. Also, as clearly shown in the drawings, the hopper 20 provides an area directly above the central portion 16 of the transport tube 16 which enables the carrier bags having passed the first sleeve means 38 to expand upwardly prior to reaching the second sleeve means 40. Refuse carrier bags are advanced toward and ruptured against the second sleeve 40 in the manner described above. It will be appreciated that small carrier bags of a size capable of fitting between the screw impeller 11 and the first or second sleeves 38 and 40 will pass through these sleeves 38 and 40 without being ruptured. Similarly, large carrier bags containing relatively soft refuse, such as paper, clothing, and the like, will also be advanced without being ruptured. However, it has been found that carrier bags of such size or containing items of such softness generally do not contain items worth salvaging. Hence, the present invention selectively ruptures only those carrier bags which are likely to contain materials worth salvaging. Having been released from the carrier bags, the refuse is expelled from the outlet end portion 17 of the transport tube onto the conveyor 37, whereupon it is delivered to the sorting area of the reclamation operation.

In accordance with the provisions of the patent statutes, the principle and mode of operation of the present invention have been explained and illustrated in its preferred embodiment. However, it must be appreciated that the present invention can be practiced otherwise than as specifically explained and illustrated without departing from its spirit or scope.

What is claimed is:

1. An apparatus for rupturing carrier bags to expose the contents therein comprising:

an elongate transport trough including an inlet end portion and an outlet end portion;

screw impeller means rotatably supported in said transport trough for advancing carrier bags placed therein toward said outlet end portion of said transport trough;

first rupturing means spaced from said inlet end portion and disposed adjacent said screw impeller means for rupturing the carrier bags as the bags are advanced past said first rupturing means;

second rupturing means spaced between said first rupturing means and said outlet end portion and disposed adjacent said screw impeller means for rupturing the carrier bags as the bags are advanced past said second rupturing means; and means positioned above said transport trough between said first rupturing means and said second rupturing means for enabling the carrier bags and the exposed contents thereof having passed said first rupturing means to expand upwardly prior to reaching said second rupturing means.

* * * * *